US006163587A

United States Patent [19]

Hessels

[11] Patent Number: 6,163,587

[45] Date of Patent: Dec. 19, 2000

[54] PROCESS FOR THE PRODUCTION OF ANTIHYDROGEN

[75] Inventor: Eric Arthur Hessels, Thornhill, Canada

[73] Assignee: York University, North York, Canada

[21] Appl. No.: 08/891,614

[22] Filed: Jul. 10, 1997

[51] Int. Cl.[7] ..... G21G 1/00

[52] U.S. Cl. ..... 376/156; 376/913

[58] Field of Search ..... 376/156, 913

[56] References Cited

U.S. PATENT DOCUMENTS 4,867,939 9/1989 Deutch ..... 376/156
4,894,208 1/1990 Griffin et al. ..... 376/195
5,034,183 7/1991 Blewett ..... 376/913
5,118,950 6/1992 Bahn et al. ..... 376/913

*Primary Examiner*—Daniel D. Wasil
*Attorney, Agent, or Firm*—Evenson, McKeown, Edwards & Lenahan, P.L.L.C.

[57] ABSTRACT

The present invention provides a process for the production of antihydrogen, comprising the steps of: (i) exciting alkali atoms to a Rydberg state; (ii) charge-exchanging the excited alkali atoms with positrons to produce Rydberg-state positronium; and (iii) charge exchanging the Rydberg-state positronium with antiprotons to produce Rydberg-state antihydrogen. Preferably, the Rydberg-state antihydrogen is permitted to decay to ground-state antihydrogen which can be trapped in a magnetic trap.

7 Claims, 1 Drawing Sheet

PROCESS FOR THE PRODUCTION OF ANTIHYDROGEN

BACKGROUND OF THE INVENTION

1. Field of the Invention

The present invention relates to the field of atomic particle physics. More specifically, the present invention relates to a process for the production of antihydrogen.

2. Description of the Prior Art

Antihydrogen is the simplest of the antimatter elements. It comprises a nucleus of a single antiproton enveloped by a single orbiting positron. In the absence of reaction with normal matter, antihydrogen is a stable species having an indefinite half-life. Antihydrogen is a potent energy storage medium and is an important reactant in matter-antimatter anihilation reactions.

There have been a number of schemes proposed for producing antihydrogen. Unfortunately, many of the schemes result in low yields of high-energy antihydrogen which is not suitable for study. One proposed process for producing antihydrogen in detectable quantities at low energies is the subject of U.S. patent Ser. No. 4,867,939 to Deutch which issued on Sep. 19, 1989. Deutch teaches a process for producing antihydrogen from antiproton-positronium collision via Auger capture. Specifically, the process comprises the interaction of antiprotons having an average energy of less than about 50 KeV and positronium having an average energy on the order of thermal energies. The positronium utilized in the process is ground-state positronium produced by bombarding an aluminum-based positronium converter with a high-energy positron beam. It is this ground-state positronium which undergoes charge-exchange with antiprotons to produce antihydrogen.

Although the Deutch process is superior to earlier processes, there is still a requirement for an improved process which can be used to produce higher yield of antihydrogen in a stable state suitable for study. It is an object of the present invention to provide such a process.

SUMMARY OF THE INVENTION

Accordingly, in one aspect the present invention provides a process for the production of antihydrogen, comprising the steps of:

(i) exciting atoms to a Rydberg state;

(ii) charge-exchanging the excited atoms with positrons to produce Rydberg-state positronium; and (iii) charge-exchanging the Rydberg-state positronium with antiprotons to produce Rydberg-state antihydrogen.

Preferrably, the Rydberg-state antihydrogen is permitted to decay to ground-state antihydrogen which can be trapped in a magnetic trap.

Recent successes in trapping large numbers of cold antiprotons ($10^5$ at 4.2K) and even larger numbers of cold positrons ($10^6$, also at 4.2K), provide the building blocks for the production of cold antihydrogen. Several methods for production of cold antihydrogen from these building blocks have been proposed, but none has a very high efficiency. Cold antihydrogen production would allow for trapping antihydrogen in a magnetic trap, similar to that used to trap neutral hydrogen atoms or molecules. Spectroscopy on such trapped antihydrogen could provide a strong test of CPT, as well as allowing for many precision tests of the physics of antimatter. Accordingly, in a preferred embodiment, the present invention provides a process using two stages of Rydberg-state charge-exchange to produce cold antihydrogen atoms from the cold trapped components.

BRIEF DESCRIPTION OF THE DRAWINGS

An embodiment of the present invention will be described, by way of example only, with reference to the accompanying drawing, in which.

DETAILED DESCRIPTION OF THE PREFERRED EMBODIMENT

Figure 1:
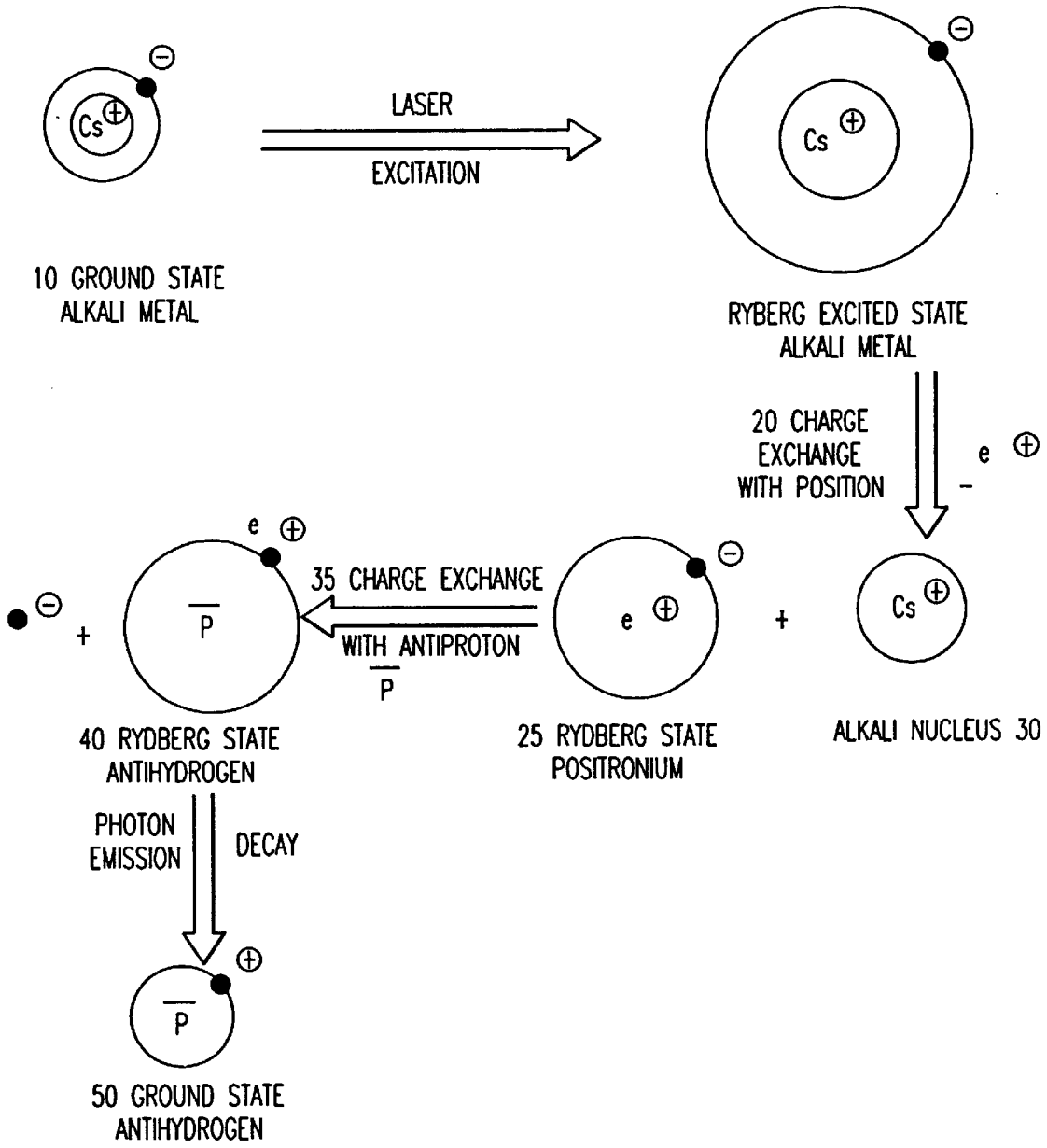
FIG. 1 is a schematic representation of a dual-charge-exchange scheme for creating antihydrogen in accordance with the present invention.

A general process for producing antihydrogen is shown schematically in FIG. 1. The process will be described with reference to the excitation of atoms such as an alkali metal atom. However, the process is equally applicable to any other atoms or molecules which can be excited to the Rydberg state. Examples of other atoms and molecules include but are not limited to $N_2$ and $O_2$ for molecules and Ar and Xe for atoms.

In the first step in the process, a ground-state atom, such as a cesium atom 10, is laser-excited to a Rydberg excited state 15. The Rydberg-state alkali metal atom 15 is then subject to charge-exchange with positron 20, producing the Rydberg-state positronium 25 and a positively charged alkali nucleus 30. In a second Rydberg-state charge-exchange, the Rydberg-state positronium 25 gives up its Rydberg positron to antiprotons 35, producing the Rydberg-state antihydrogen 40. This antihydrogen atom soon decays down to the ground state by photon emission, to yield ground-state antihydrogen 50. The efficiency of the process results from the extremely large cross sections for Rydberg charge-exchange.

The preferred process of the present invention will now be described in more detail with reference to the production and trapping of cold antihydrogen, i.e., antihydrogen produced at a temperature of around 4K.

Charge-exchange processes between slow ions and Rydberg atoms have extremely large cross sections. For a Rydberg state with principal quantum number n, the radius of the atomic wavefunction is approximately $n^2 a_o$, leading to a geometric area of $n^4 \pi a_o^2$. Here $a_o = 0.529 \times 10^{-10}$ m is the Bohr radius. For slow ions, charge-exchange cross sections are approximately an order of magnitude larger than these already large geometric area, i.e., $$\sigma_{CE} \doteq 10 n^4 \pi a_o^2 \qquad \text{[Equation 1].}$$

Here "slow" refers to ions speeds v less than $v_c = \alpha c/n$, which is the characteristic speed of the electron in its Rydberg orbit, where $\alpha$ is the fine-structure constant and c is the speed of light. The Rydberg charge-exchange process has been extensively studied by MacAdam, et al and others, see, for example, *Phys. Rev. A* 34, 4661 (1986) and *Phys. Rev. Lett.* 75, 1723 (1995), the contents of both of which are incorporated herein by reference. These experiments show large charge-exchange cross sections at low reduced velocity $v/v_e$, with cross sections dropping off very quickly for $v/v_e > 1$. The experiments also show that the ion captures the electron into states which have a similar binding energy to that of the electron in the Rydberg target.

The process of the present invention creates antihydrogen via two sequential Rydberg charge-exchange collisions as shown schematically in FIG. 1. The first charge-exchange is between a thermal beam of cesium (or other alkali) atom which has been laser excited up to a high-n Rydberg state an positrons which are trapped and cooled to 4K. The product of this charge-exchange is Rydberg states of positronium. When these Rydberg positronium atoms collide with 4-K trapped antiprotons, a second charge-exchange occurs, producing Rydberg states of antihydrogen. The cesium Rydberg atoms can be thought of as a catalyst to induce the combination of the positrons and antiprotons. The following paragraphs provide some of the details of the scheme.

Cesium atoms can be excited to high-n Rydberg states via a two- or three-step laser excitation. For example, efficient three-step CW excitation is possible via diode-laser excitation to the 6p state, followed by dye-laser excitation to the 11d state, followed by a Stark-tuned $CO_2$ laser excitation up to a high-n Rydberg state. Other excitation schemes are also possible, both in cesium and in other atoms. Using such laser-excitation schemes, Rydberg states can easily be created in large densities. However, because of their large cross sections, collisional and radiative effects become important if the density is too high. For n=50 atoms, densities of up to $10^5$ Rydberg atoms per $cm^3$ should lead to sufficiently small collisional effects, while still allowing for a very fast rate of charge-exchange.

The radiative lifetimes of Rydberg atoms are very long, especially for state with large orbital angular momentum L. Rydberg atoms are also extremely sensitive to electric and magnetic fields. The electric and magnetic fields present near the traps will mix the L and m states within a particular n manifold. An atom in a mixture of all L and m states for a particular n has a radiative decay rate of:

$$1/\tau_{rad} \doteq 4/3 n^{-5} \alpha^5 mc^2/h[\ln(2n-1)-0.365], \quad \text{[Equation 2]}$$

where $\mu$ is the reduced mass of the Rydberg electron.

Transitions induced by blackbody radiation, which are usually important contributions to the lifetimes of Rydberg states, are not a major concern here since the ambient temperature near the Rydberg atoms would be 4K, leading to a blackbody-radiation-induced transition rate of $1/\tau_{BB} \doteq (4n^{-2}\alpha^3 k_B T/3)/h \doteq n^{-2} 4\times10^4 s^{-1}$, wherein $k_B$ is Boltzmann's constant, h is Planck's constant and T is the temperature in Kelvin. This rate is smaller than the radiative decay rate for n's of less than 100. For cesium (Cs) with a principle quantum number n=50, the radiative lifetime of this statistically mixed state is 3.5 $\mu$s. During these 3.5 $\mu$s, the thermal cesium atoms travel a distance of approximately 1 m. Thus, it is possible to laser excite the Rydberg atoms at a location well separated from the trapped positrons.

Because of the weak binding of the Rydberg electron to the core of the atom, relatively small electric fields are capable of ionizing the atom. Electric fields of $$E_{SI} = n^{-4}(\mu/m_e)^2 3\times10^8 \text{V/cm} \quad \text{[Equation 3]}$$

are sufficient to Stark ionize a state with principal quantum number n, and thus the fields along the cesium beam for an n=50 state must be smaller than 50 V/cm.

The scaling of $E_{SI}$, $\tau_{rad}$ and $\sigma_{CE}$ with n are the main considerations for the choice of n. The charge-exchange cross section (Equation 1) increases quickly with n, however, the higher-n states Stark ionize at smaller fields (Equation 3), putting an upper limit on the usable n's. The lifetime in the presence of fields (Equation 3) determines how far an atom travels in an n state. We will use $n_{CS}$=50 as an example.

The Cs atoms are travelling at a speed $v_{Cs}$ of approximately 300 m/s, the positron has a speed v of approximately 11 000 m/s as given by the Boltzmann distribution for 4K, and an n=50 electron will have a characteristic speed $v_c$ of $\alpha c/50$ or 44 000 m/s. Thus, this collision has a reduced velocity $v/v_c$ of less than one. Thus, the charge-exchange cross section $\sigma_{CE}$ for this process is expected to be approximately 10 $n^4 \pi a_o^2$. Because the positron is in a trap, the charge-exchange is likely to occur in electric and magnetic fields. Theory and experiment show that the presence of fields does not greatly affect charge-exchange cross sections.

The large cross section, along with a cesium Rydberg beam of density $\rho_{Ryd}$ of $10^5/cm^3$, leads to a characteristic time $(\rho_{Ryd}\, \sigma_{CE}\, V)^{-1}$=2 $\mu$s for a positron to capture an n=50 Rydberg electron. The small value of this characteristic time indicates the fast rate of this process, but the time is long enough to make a second charge-exchange collision unlikely before the neutral positronium exits the trap. For a trap with $N_c=10^6$ positrons, if the cross-sectional area A of the trap volume is 0.1 $cm^2$, there will be $v_{Cs}\, \rho_{Ryd}\, A=3\times10^8$ Rydberg atoms entering the volume of the trap per second, or the required $10^6$ Rydberg atoms entering the trap every 3 ms. Thus, after approximately 3 ms, the trap will be emptied of all of its positrons, all of them having captured a Rydberg electron. In addition, almost every Rydberg atom which passed through the trap lost its electron to a positron, indicating a surprising result of almost 100% efficiency of charge-exchange. The net result is that only about $10^6$ Rydberg atoms need to be released into the positron trap, a very small quantity even in the extremely high vacuum ($<5\times10^{-17}$ Torr) used in positron and antiproton traps. Annihilation of the positrons by the incident cesium atoms is not a concern for this small quantity of cesium.

Unless the positron trap can be reloaded on the millisecond time scale, there is no necessity to have as high a density of Rydberg cesium atoms. If this density were lower, the rate of positron production would be lower, but the charge-exchange would still be nearly 100% efficient.

The Rydberg positronium atoms exit the positron trap isotropically since the initial momenta of both the positrons and the Cs Rydberg electrons are nearly isotropically distributed.

The final n states populated in the charge-exchange is peaked near $n_{Ps}=n_{Cs}/2^{1/2}$. Since the poitronium binding energy is $E_{Ps}=-Ry/2n_{Ps}^2$, whereas the cesium binding energy is $E_{Cs}=-Ry/n_{Cs}^2$, $n_{Ps}=n_{Cs}/2^{1/2}$ corresponds to the same binding energy before and after the charge-exchange.

The lifetime of an n=35 Rydberg positronium state (assuming magnetic and electric fields mix all L and m states) is 1 millisecond, as given by equation 1. The annihilation rate is not a concern for these Rydberg states since the overlap between the electron and positron wavefunctions is small for these large-size atoms. The positronium atoms are capable of travelling a distance of meters without decaying out of the Rydberg state or annihilating and thus can easily survive the distance between the positon trap and the antiproton trap.

Both electric and magnetic fields have a large effects on these Rydberg states of positronium. From equation 2, dc electric fields of greater than $n_{Ps}^{-4} 3\times10^8/4$V/cm will cause the Rydberg states to Stark ionize. (For $n_{Ps}$=35, this corresponds to a field of 50 V/cm.) The motional electric field due to the relativistic transform (even through $V_{Ps}/c$ is typically about 0.000 05 ) of a dc magnetic field of 0.3 T is sufficient to Stark ionize the positronium atom. If higher fields than these would be required for the traps, one would have to choose a lower n than 50 for the cesium Rydberg state, taking advantage of the $n^{-4}$ scaling of the field required to Stark ionize a Rydberg state.

For the second Rydberg charge-exchange, the positronium is travelling at speeds of approximately 15 000 m/s, and the antiprotons are moving with speeds given by a Boltzmann distribution for 4K, typically 250 m/s. Thus, the relative speed between the two is less than $\frac{1}{2}\alpha c/35=30\,000$ m/s and the cross section for charge-exchange is again expected to be large (approximately $\sigma_{CE}=10n_{Ps}^4\pi a_o^2$).

Because of the $4\pi$ steradian distribution of the Rydberg positronium atoms, the efficiency of the dual-charge-exchange process is maximized when the distance between the trapped positrons and the trapped antiprotons is minimized. If the distance between the two trapped species is d=0.2 cm, the fraction of positronium atoms which charge-exchange with $N_P=10^6$ antiprotons is given by the fraction $N_P\sigma_{CE}/(4\pi d^2)$ which equals $3\times10^{-4}$ for $n_{Ps}=35$. With the $N_{Ps}=10^6$ positronium atoms created in the first charge-exchange, this implies a production of $N_{Ps}N_P\sigma_{CE}/(4\pi d^2)=$ 300 cold antihydrogen atoms. This number indicates that the two-stage Rydberg charge-exchange method is an efficient way to produce antihydrogen atoms. In fact, with a Rydberg Cs density of $1\times10^5/cm^3$, these 1000 antiprotons are created within a few miliseconds, leading to an antiproton production rate of nearly $10^5$/s.

It should also be noted that antiprotons which do not charge-exchange remain trapped and so can be used again once the positron trap is reloaded. By repeated loadings of the positron trap, a large fraction of the antiprotons can be converted into Rydberg states of antihydrogen.

Because the antiprotons are more massive than the positronium, the antihydrogen continues to move in the direction and speed of the antiprotons. Thus, they move in an isotropic 4-K Maxwellian distribution. The final n states for these antihydrogen atoms is expected to be peaked near n=50 for $n_{Cs}=50$ cesium Rydberg atoms.

These Rydberg states will cascade back down to the ground state. In the presence of electric and magnetic fields, all of the L states for a particular n are mixed, and the expected lifetimes are given by Equation 1. The antihydrogen will decay out of the n=50 state in a few milliseconds. In this time, the antihydrogen atoms will have travelled a distance of about 50 cm. Those antihydrogen atoms which are on the cold end of the Maxwellian distribution will be the most probable for magnetic trapping, and these will have travelled a shorter distance. Note that colder antiprotons could be helpful in reducing this distance. Also note that Rydberg states have very large diamagnetism, and it might be possible to set up magnetic fields which trap the Rydberg antihydrogen atoms, or guide them towards a ground-state magnetic trap.

With the large number of cold antihydrogen atoms predicted for this two-stage Rydberg charge-exchange method, will be possible to magnetically trap at least some of them.

What is claimed is:

1. A process for the production of antihydrogen, comprising the steps of (i) exciting atoms to a Rydberg state;

(ii) charge-exchanging the excited atoms with positrons to produce Rydberg-state positronium; and (iii) charge-exchanging the Rydberg-state positronium with antiprotons to produce Rydberg-state antihydrogen.

2. A process according to claim 1, further comprising the step of trapping or guiding the Rydberg-state antihydrogen using magnetic fields.

3. A process according to claim 1, further comprising the step of permitting the Rydberg-state antihydrogen to decay down to ground-state antihydrogen.

4. A process according to claim 3, further comprising the step of trapping the ground-state antihydrogen in a magnetic trap.

5. A process according to claim 1, wherein the atoms are excited by means of lasers.

6. A process according to claim 1, wherein the atoms are cesium atoms.

7. A process according to claim 1, where cesium atoms are: (i) excited to the 6p state with a diode-laser; (ii) excited to the 11d state with a dye-laser; and finally excited to a high-n Rydberg state with a Stark-tuned $CO_2$ laser.

* * * * *